United States Patent [19]

Sipe et al.

[11] Patent Number: 4,828,468

[45] Date of Patent: May 9, 1989

[54] BALANCED ROLLER VANE PUMP HAVING REDUCED PRESSURE PULSES

[75] Inventors: Paul A. Sipe, Marshall; Michael D. Davis, Coldwater, both of Mich.

[73] Assignee: Eaton Corporation, Cleveland, Ohio

[21] Appl. No.: 858,875

[22] Filed: May 1, 1986

Related U.S. Application Data

[63] Continuation-in-part of Ser. No. 705,452, Feb. 25, 1985, abandoned.

[51] Int. Cl.[4] ..... F04C 2/344

[52] U.S. Cl. ..... 418/225

[58] Field of Search ..... 418/225–227

[56] References Cited

U.S. PATENT DOCUMENTS

| | | | |
|---|---|---|---|
| 2,830,543 | 4/1958 | Roth | 418/234 |
| 3,025,802 | 3/1962 | Browne | 418/225 |
| 3,412,685 | 11/1968 | Connelly | 418/225 |
| 4,105,377 | 8/1978 | Mayall | 418/173 |
| 4,486,150 | 12/1984 | Davis | 418/225 |
| 4,538,977 | 9/1985 | Ruhl | 418/225 |
| 4,659,296 | 4/1987 | Bristow | 418/225 |

FOREIGN PATENT DOCUMENTS

| | | | |
|---|---|---|---|
| 1244019 | 9/1960 | France | 418/225 |
| 2118247 | 10/1983 | United Kingdom | 418/225 |

*Primary Examiner*—William L. Freeh

*Attorney, Agent, or Firm*—L. J. Kasper

[57] ABSTRACT

A balanced rotary pump is disclosed of the type including a pumping element (17) having a rotor member (25) defining a plurality of slots (27). Each of the slots receives a radially displaceable roller vane member (29). The pumping chamber is defined by a pair of inlet arc surfaces and a pair of discharge arc surfaces (65) of progressively decreasing radius. Each of the slots (27) includes a driving surface (73), each of which includes a substantial surface portion (77) oriented at a negative angle relative to a radial line passing through the center of the adjacent roller vane member. The engagement of each of the roller vane members (29) and its respective negative surface portion (77) is effective to act to reduce slightly the net radially outward force acting on the roller vane member, to reduce bouncing thereof as the roller vane member passes from the inlet arc surface to the discharge arc surface. The result is improved engagement of the roller vane member and the adjacent cam surface, reduced leakage past the vane member, and a reduction in pressure pulses and noise.

2 Claims, 7 Drawing Sheets

BALANCED ROLLER VANE PUMP HAVING REDUCED PRESSURE PULSES

CROSS-REFERENCE TO RELATED APPLICATION

The present application is a continuation-in-part of U.S. Ser. No. 705,452, filed Feb. 25, 1985, now abandoned.

BACKGROUND OF THE DISCLOSURE

The present invention relates to positive displacement hydraulic pumps of the roller vane type, and more particularly, to an improved rotor configuration which provides reduced pressure pulses.

Pumps of the type to which the present invention relates include a housing defining a pumping chamber, and a pumping element rotatably disposed in the pumping chamber and defining expanding and contracting fluid chambers. The housing means defines a fluid inlet port in communication with the expanding fluid chambers, and a fluid outlet port in communication with the contracting fluid chambers. The pumping element includes a rotor member mounted for rotation with an input shaft, the rotor member having a plurality of slots. Each of the slots receives a radially displaceable roller vane member. The pumping chamber is defined by a continuous arcuate wall surface including an inlet arc surface of progressively increasing radius in the direction of rotation of the rotor member, and a discharge arc surface of progressively decreasing radius.

Although the present invention could be utilized with various types of roller vane pumps, it is especially advantageous when used with a balanced roller vane pump, i.e., a pump in which there are two oppositely disposed expanding fluid chambers, and two oppositely disposed contracting fluid chambers. The term "balanced" derives from the fact that the arrangement of fluid chambers results in balanced hydraulic forces acting on the rotor member.

One of the reasons for the present invention being especially advantageous for use in balanced pumps is that a balanced pump is more likely to utilize what will be referred to hereinafter as a "high displacement" cam surface for the discharge arc surfaces. Although the term "high displacement" cam surface will be described in greater detail in the subsequent specification, it will be understood by those skilled in the art that the term does not define or refer to any particular cam surface geometry, but instead, refers to the fact that the discharge arc surface must accomplish the full radially inward displacement of the roller vane over a relatively small angular displacement of the rotor member.

One of the primary problems associated with pumps of the type described is the generation of undesirable pressure pulses during the pumping cycle. Such pulses may be transmitted through the hydraulic lines to other components such as the vehicle steering gear and steering column which can then translate the pressure pulses into noise, audible to the driver. Pressure pulses and noise emanating from the pump can be generated in several ways, and it has long been an object of those skilled in the art to identify and eliminate such sources of noise and pressure pulses.

Accordingly, it is a primary object of the present invention to identify and eliminate additional sources of pressure pulses and noise which have been previously unrecognized.

Those skilled in the art have for a long time recognized that one of the potential causes of pressure pulses is intermittent leakage of fluid from a contracting fluid chamber, past one of the roller vanes, to an expanding fluid chamber. It has also been recognized by those skilled in the art that one likely cause of such intermittent leakage is radial movement of the roller vane, into and out of engagement with the discharge arc surface as the roller vane moves through the pumping (discharge) arc. It has generally been assumed that such movement or bouncing of the roller vane could be prevented by exerting greater net radially outward force on the roller vane to keep it in contact with the discharge arc surface.

Accordingly, it is another object of the present invention to identify and reduce substantially the causes of the roller vane bouncing and the resultant intermittent leakage.

The above and other objects of the present invention are accomplished by the provision of an improved rotary pump of the type described above wherein each of the discharge arc surfaces comprises a high displacement cam surface. Each of the slots includes a drive surface disposed to engage and drive the adjacent one of the roller vane members when the pumping element is operating in the pumping mode. Each of the slots also includes an opposite surface. Each of the driving surfaces includes a substantial surface portion oriented at a negative angle relative to a radial line passing through the axis of rotation of the pump, and through the center of the adjacent roller vane member. The engagement of each of the roller vane members and its respective negative surface portion acts on the roller vane member in a direction to reduce the net radially outward force, and is effective to reduce the radial movement of the roller vane member into and out of engagement with the adjacent discharge arc surface.

DESCRIPTION OF THE PREFERRED EMBODIMENT

Figure 1:
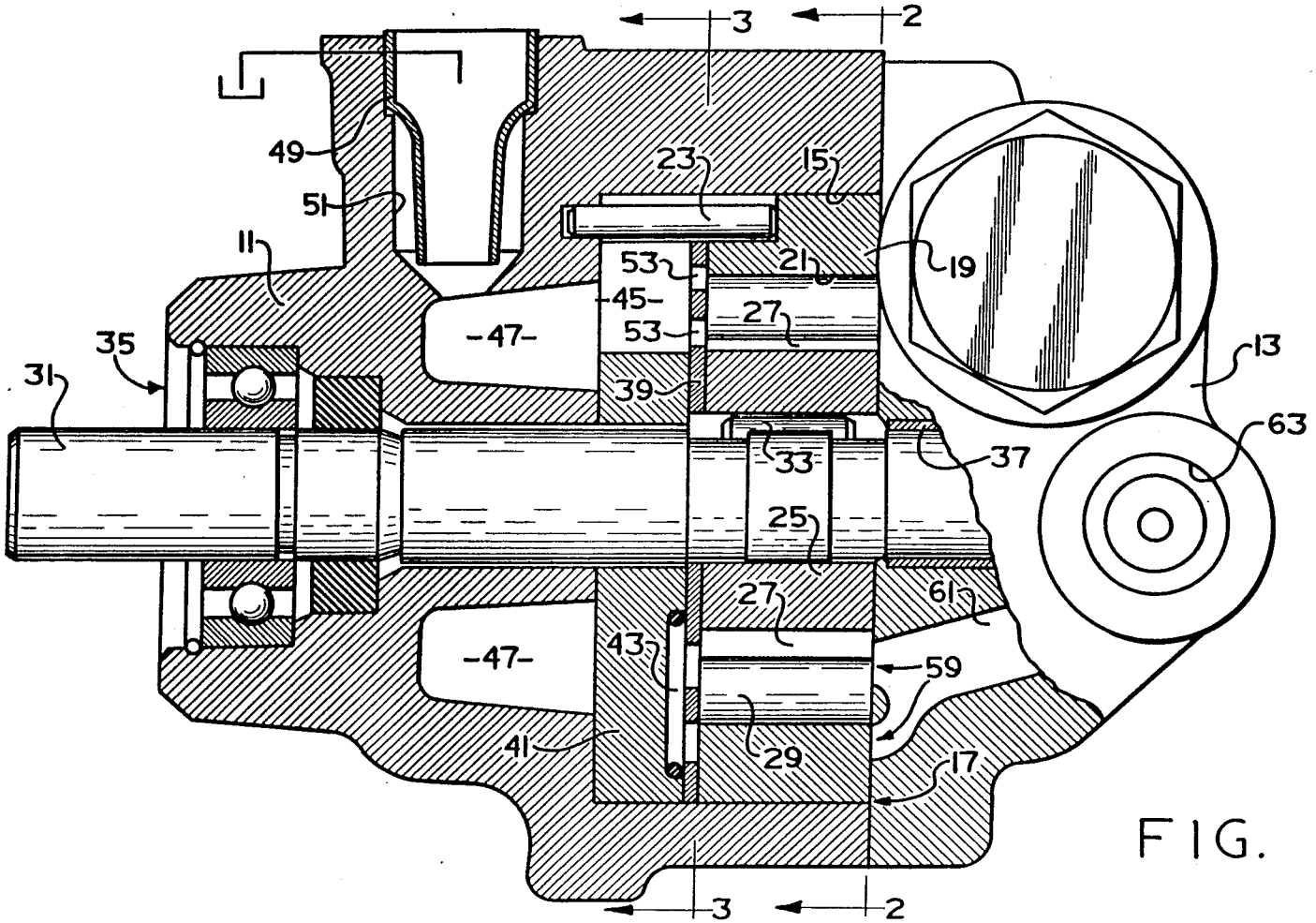
FIG. 1 is an axial cross section of a rotary pump of the type with which the present invention may be utilized.

Referring now to the drawings, which are not intended to limit the invention, FIG. 1 is an axial cross section of a typical automotive power steering pump of a general type which is commercially available and therefore, will be described only briefly herein.

Figure 2:
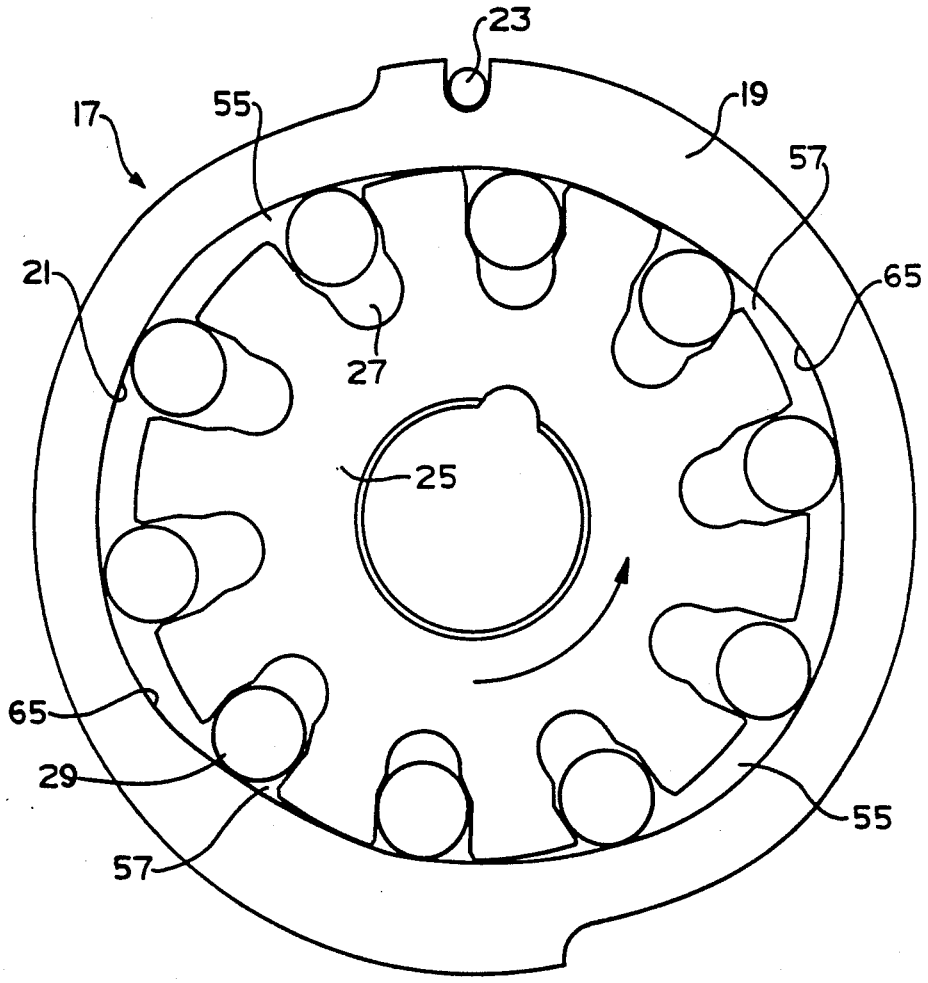
FIG. 2 is a transverse view, taken on line 2—2 of FIG. 1, showing only the pumping element and cam member.

The pump comprises several portions, including a body portion 11 and a cover portion 13. The body portion 11 defines an annular pumping chamber 15, and disposed within the chamber 15 is a pumping assembly 17. Referring also now to FIG. 2, the pumping assembly 17 includes a cam ring 19 which defines an internal cam surface 21. The cam ring 19 is held in proper circumferential alignment, relative to the body portion 11, by means of an axial pin 23. The body portion 11 and cover portion 13 are held in tight sealing engagement by means of a plurality of bolts (not shown).

Disposed within the cam ring 19 is a rotatable pumping element 25 (rotor), which defines a plurality of radially extending slots 27, each of the slots 27 receiving a cylindrical roller vane member 29, as is well known in the art. In the subject embodiment of the invention, there is a relatively close fit between each slot 27 and the respective roller 29. As a result, fluid is not readily communicated radially through the slot, past the roller.

The pump includes an input shaft 31 which is capable of transmitting a rotary motion, such as from the vehicle engine, to the rotor 25, by means of a suitable pin connection 33. The input shaft 31 is supported for rotation within the body portion 11 by a suitable bearing set 35, and is supported for rotation within the cover portion 13 by a suitable bushing member 37. As the rotor 25 rotates, the rollers 29 are intended to remain in engagement with the cam surface 21, which is configured to cause each of the rollers 29 to move radially outwardly and inwardly as the pumping assembly 17 accomplishes fluid intake and fluid discharge, respectively, as is well known in the art.

Referring again primarily to FIG. 1, the pumping assembly 17 includes a flexible end plate (port plate) 39 disposed adjacent the left end of the cam ring 19 and rotor 25. Disposed adjacent the end plate 39 is a backup plate 41 which defines a pair of kidney-shaped pressure chambers 43 (only one of which is shown in FIG. 1), and a pair of cutout portions 45 (only one of which is shown in FIG. 1). It will be understood by those skilled in the art that not all portions of FIG. 1 are taken on the same plane, but instead, the various elements are positioned as shown in FIG. 1 for the purpose of illustrating all of the important elements of the pump in a single view.

The body portion 11 defines a pair of diametrically opposed inlet chambers 47, each of which is in fluid communication with a system reservoir by means of a reservoir fitting 49, which is seated within a stepped bore 51 defined by the body portion 11. Inlet fluid flows from the system reservoir, through the reservoir fitting 49 into the inlet chambers 47, and from there, through the respective cutout portions 45, and through two pairs of diametrically opposed intake ports 53, and into the pair of expanding fluid chambers 55. At the same time, pressurized fluid is pumped from the pair of contracting fluid chambers 57, then through a pair of diametrically opposed discharge ports 59, and into a discharge chamber 61 which is in fluid communication with a discharge port 63 defined by the cover portion 13. It should be understood that the intake and discharge ports 53 and 59 are being described in connection with FIG. 3 only, merely for simplicity, and that the cover portion 13 includes the same port arrangement as does the end plate 39.

Figure 3:
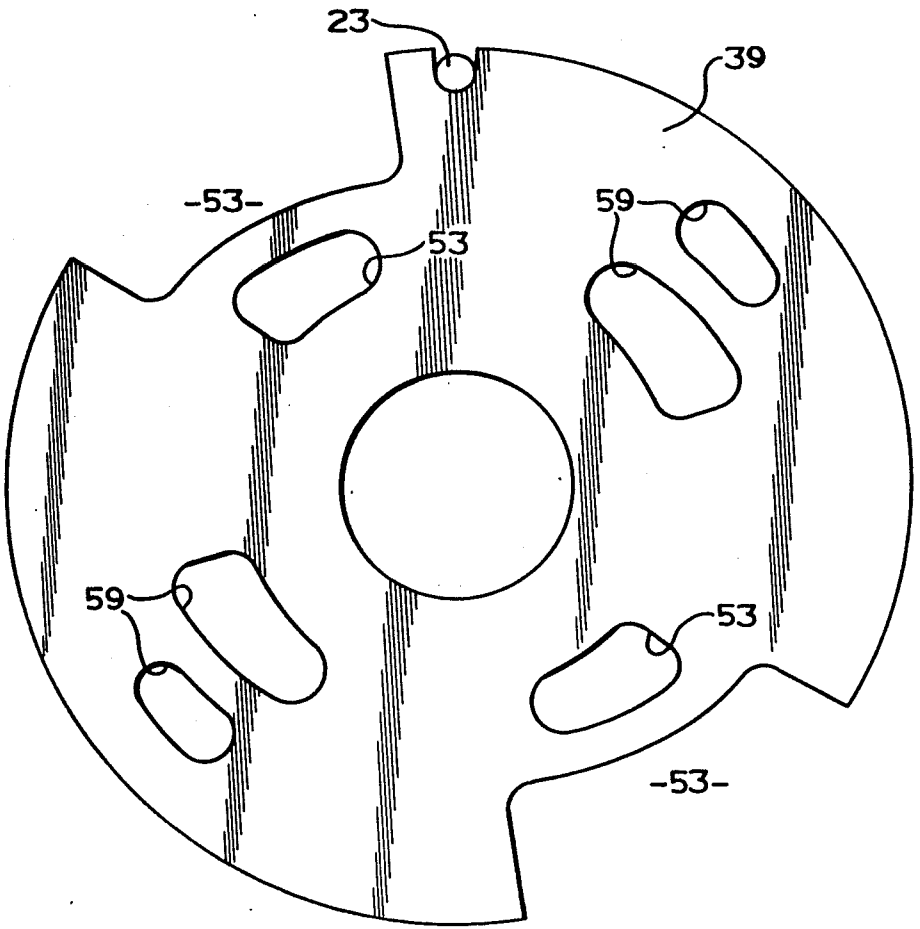
FIG. 3 is a transverse view, taken on line 3—3 of FIG. 1, illustrating only the port plate and the intake and discharge ports.

Referring now primarily to FIGS. 2 and 3, it is believed that those skilled in the art are generally knowledgeable regarding matters such as the varying radius of the different portions of the cam surface 21, and the relative circumferential spacing of these cam portions and the intake and discharge ports 53 and 59. Therefore, the particular geometry of the cam surface 21, rotor 25, slots 27, etc., will not be described in great detail herein. As was mentioned in the background of the specification, it is one feature of the present invention that the cam surface 21 include a pair of discharge arc surface portions 65, because the pump is "balanced", and that each of the surface portions 65 comprises a "high displacement" cam surface. This feature is significant to the present invention because, as noted previously, there has been an assumption that greater net radially outward force is needed to keep the roller vane in contact with the surface portion 65. This assumption has been based on an analysis of the radial forces acting on the roller vane 29 wherein the "available" (centrifugal) radial forces acting outwardly on the roller vane are compared to the "required" radial forces (i.e., the theoretical outward force required to maintain contact with the cam). If the available force is greater than the required force, as is almost always the case in an unbalanced pump, the roller vane will maintain contact with the cam surface, i.e., the roller vane will remain "stable". However, if the available force is less than the required force, there is then a tendency for the roller vane not to remain in contact with the cam surface, but instead, to become "unstable". Therefore, for purposes of the present invention, the term "high displacement" cam surface will be understood to refer to a discharge arc surface portion in which the available radial forces are less than the required radial forces on the roller vane such that the roller vane tends to become unstable.

Figure 4:
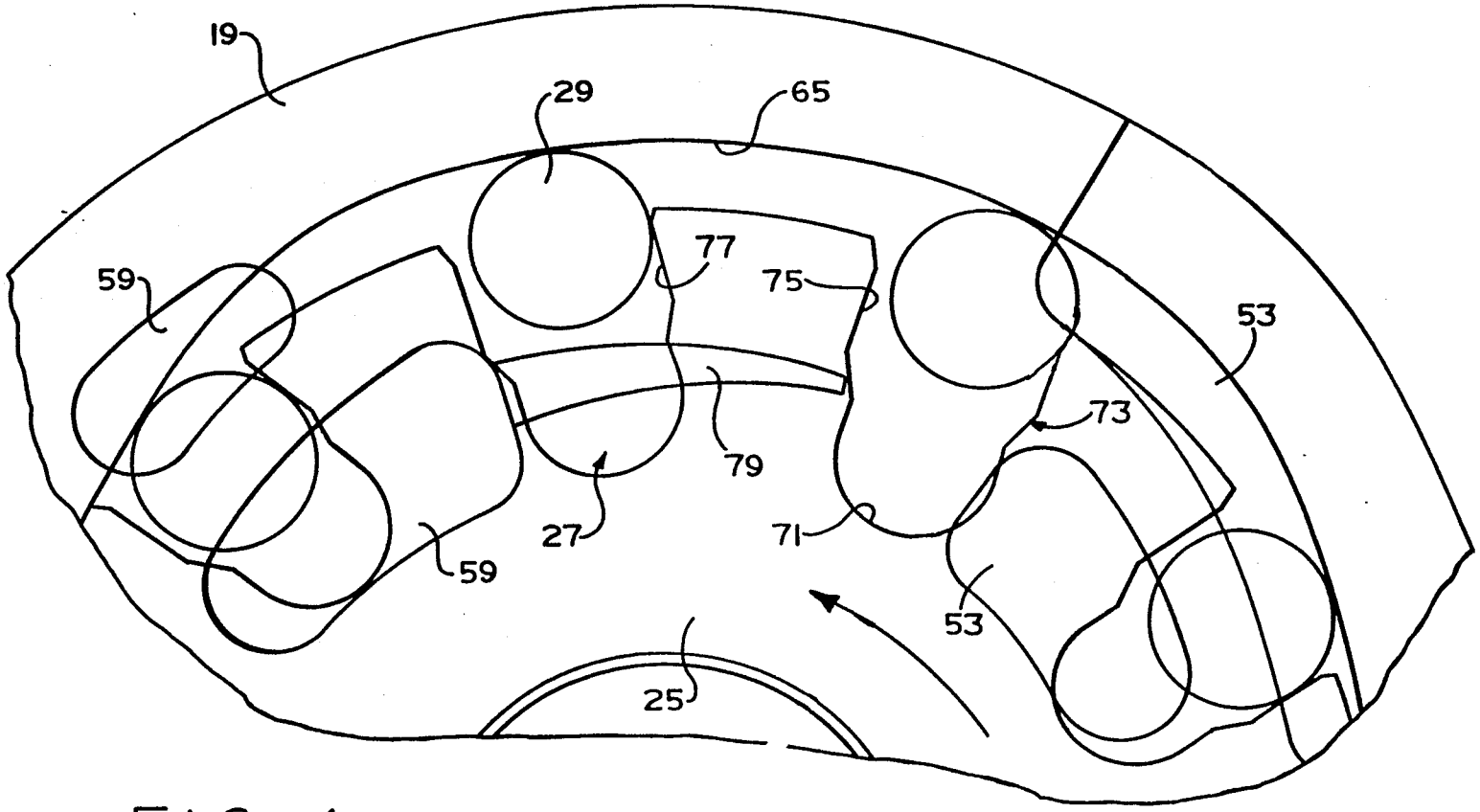
FIG. 4 is a somewhat schematic overlay view, greatly enlarged, showing both the pumping element and the adjacent intake and discharge ports.

Referring now to FIG. 4, the configuration and orientation of each of the slots 27 will be described in greater detail. Each of the slots 27 includes a radially inner, generally U-shaped portion 71, and a circumferentially-enlarged portion defined by a driving surface, generally designated 73, and an opposite surface 75. The surface 73 is referred to as a "driving" surface because, when the rotor member 25 is rotating in the counterclockwise direction as shown in FIG. 4, it is the surface 73 which engages the respective roller vane 29 and drives it through the pumping (discharge) arc portion 65.

Figure 4B:
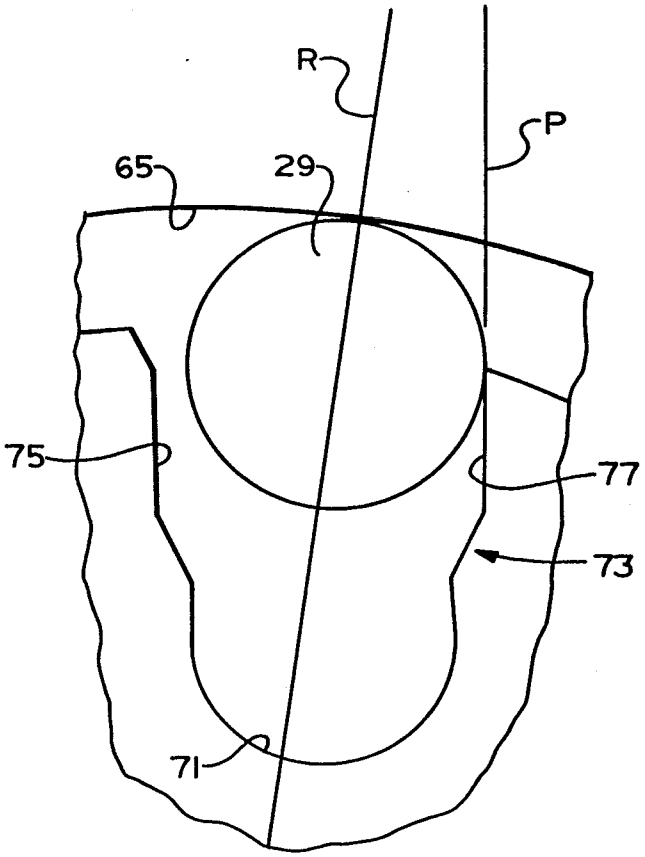
FIG. 4B is a further enlarged view similar to FIG. 4A, illustrating the "negative angle" driving surface of the present invention.
Figure 4A:
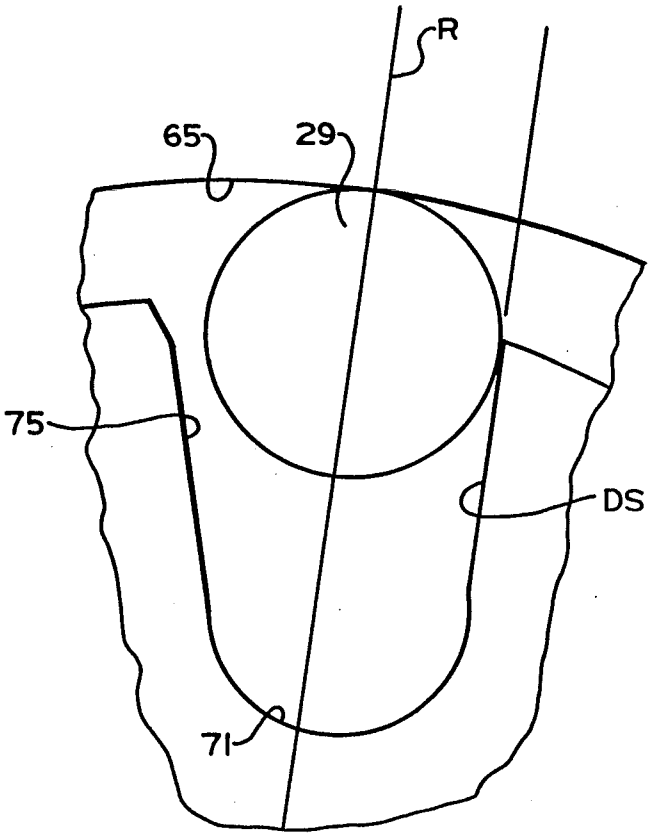
FIG. 4A PRIOR ART
FIG. 4A is a further enlarged view similar to FIG. 4 illustrating the prior art "neutral" driving surface.

Referring now to FIG. 4A, there is illustrated a prior art driving surface of the type which will be referred to hereinafter as "neutral", and is of the type shown in U.S. Pat. No. 3,025,802, assigned to the assignee of the present invention. In the prior art, it has been conventional to have the driving surface (DS) oriented parallel to a radial line R which extends from the axis of rotation of the rotor 25 through the center of the roller vane member 29. Such an orientation of the driving surface (DS) is referred to as "neutral" because the force which it exerts on the roller vane member 29 is perpendicular to the radial line R, but does not exert any significant radial force, either inwardly or outwardly, on the roller vane 29.

As mentioned previously, in a rotary pump of the type described, utilizing a high-displacement cam surface, it was believed that roller vane stability could be increased by increasing the "available" radial forces acting outwardly on the roller vane. The result would be a reduction in roller vane bouncing and intermittent leakage across the roller vane and the resulting pressure pulses. However, during the development and testing of the commercial product which embodies the present invention, it was discovered that if the driving surface 73 includes a surface portion 77 which is oriented at a "negative" angle, relative to the radial line R, the pressure pulses are reduced substantially. Referring now to FIG. 4B, it may be seen that by "negative angle", it is meant that the surface portion 77 of the driving surface 73 is oriented such that a plane P containing the surface portion 77 and the radial line R converge in a radially outward direction. As may best be seen in FIG. 4B, this orientation of the surface portion 77 is such that it would appear to exert on the roller vane 29 a slight force in the radially inward direction. This would appear to be directly contrary to the understanding of those skilled in the art that the forces acting outwardly on the roller vane should be increased to maintain roller vane stability, i.e., to keep the roller vane in contact with the discharge arc surface 65. Although the mechanism by which the negative surface portion 77 reduces roller vane bouncing is unknown, it has been hypothesized that the bouncing of the roller vane, in the prior art device, is caused by the sudden change of the "required" radial force at the end of the inlet arc (which is known and understood by those skilled in the art), and this sudden change results in roller vane impact on the discharge arc surface, but the slight "scooping" action which the negative surface portions 77 exert on the roller vane produces an inward force to inhibit and minimize the bouncing of the roller vane.

Figure 5:
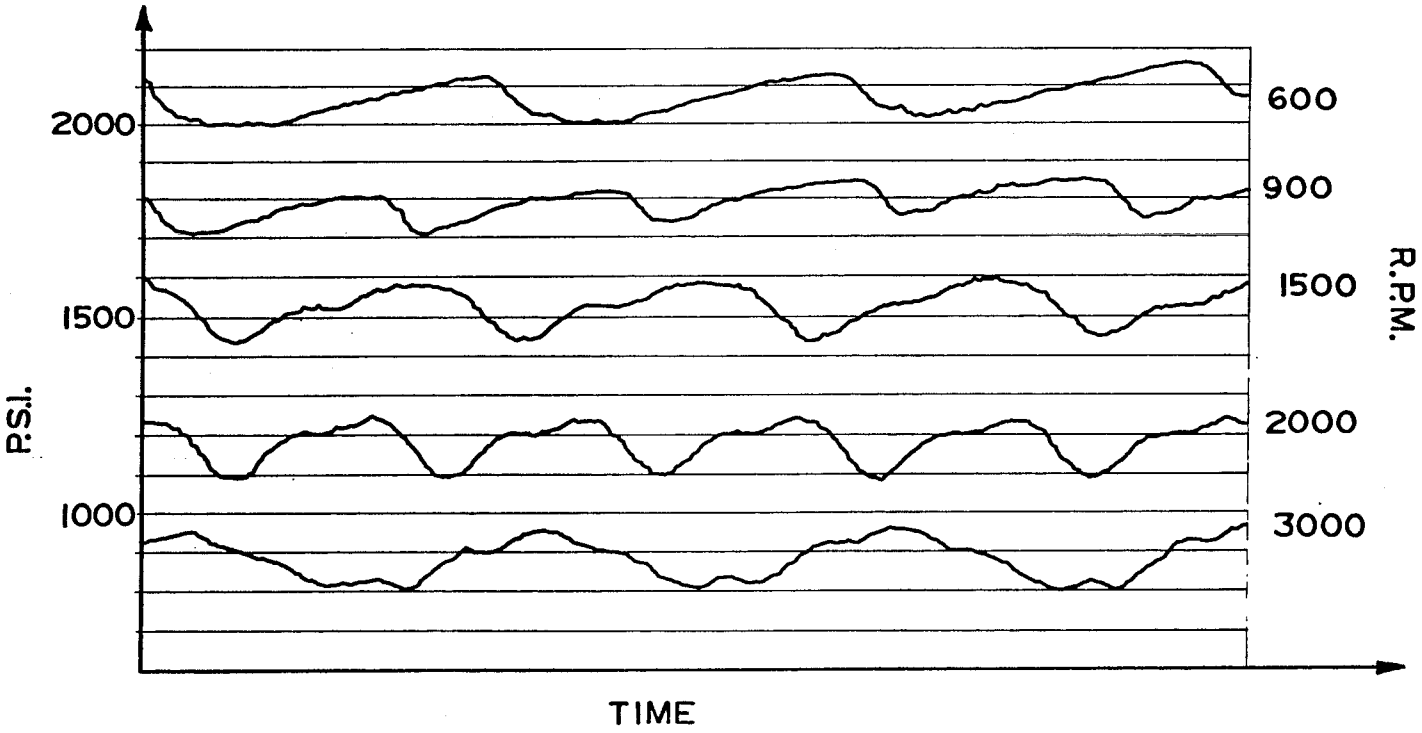
FIG. 5 PRIOR ART
FIGS. 5 and 6 are graphs of pressure pulses at various pressures and speeds, FIG. 5 illustrating pressure pulses for a prior art pump, and FIG. 6 illustrating pressure pulses for a pump made in accordance with the invention.
Figure 6:
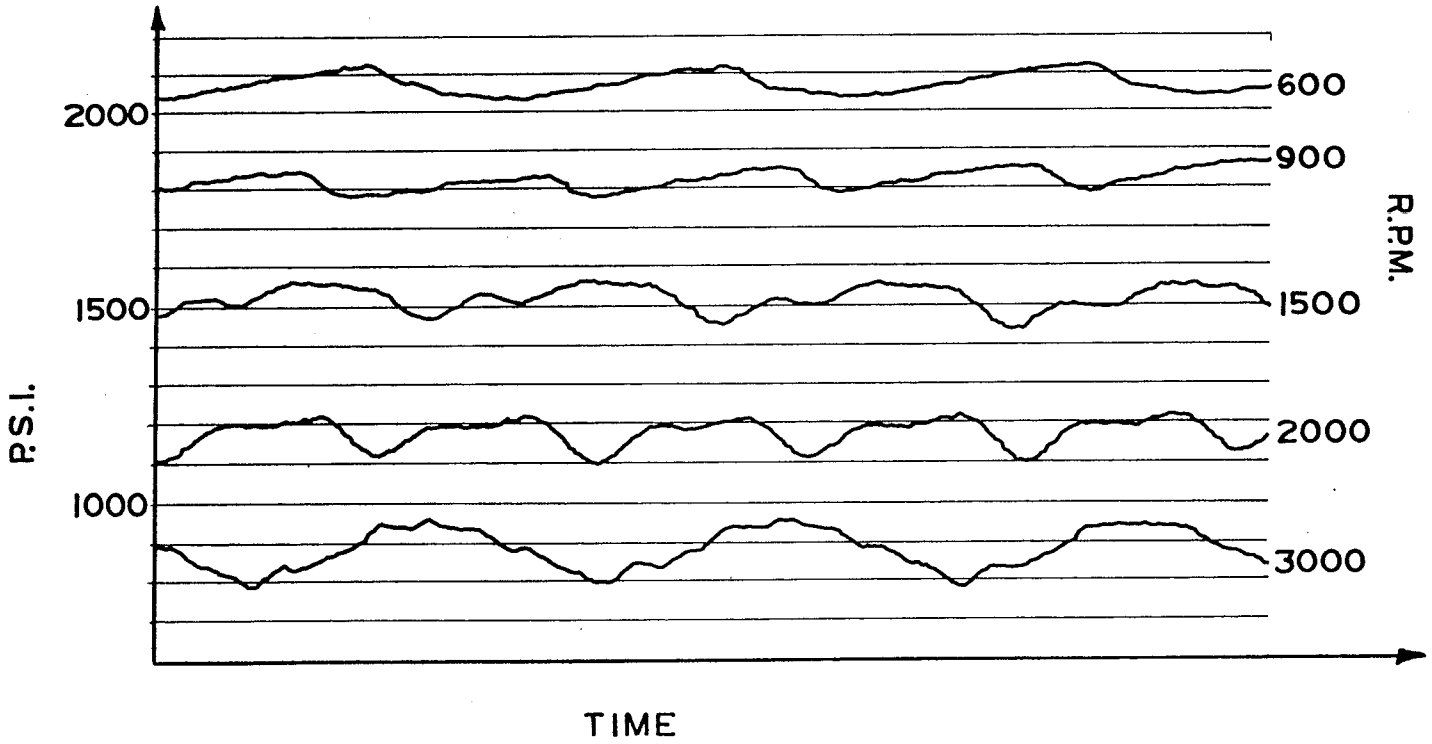

Referring now to FIGS. 5 and 6, there is presented a comparison of the pressure pulses with and without the present invention. It may be seen that each of FIGS. 5 and 6 is a graph of instantaneous pressure versus time, but in each FIG., five different pressure pulse graphs were generated, at the following rotational speeds: 600 rpm.; 900 rpm.; 1,500 rpm.; 2,000 rpm. and 3,000 rpm.

The unexpected effectiveness of the present invention may be seen by comparing the prior art (FIG. 5) with the invention (FIG. 6) for each of the five different speeds. For example, at 600 rpm. the discharge pressure of the prior art device varied between about 2,000 psi. and about 2,130 psi., a pulse amplitude of about 130 psi. By way of comparison, with the present invention, the discharge pressure varied between about 2,040 psi. and about 2,120 psi., a pulse amplitude of only 80 psi. As will be appreciated by those skilled in the art, the difference between a pulse of 130 psi. and a pulse of 80 psi., in terms of generated noise, can be quite substantial and noticeable to the vehicle operator. Similarly, at 2,000 rpm., the discharge pressure of the prior art device varied between about 1,100 psi., and about 1,240 psi., a pulse amplitude of about 140 psi. By way of comparison, the discharge pressure of the pump including the present invention varied between about 1,110 psi. and about 1,210 psi., a pulse amplitude of only about 100 psi.

Referring again to FIG. 4, it may be seen that each of the inner discharge ports 59 has a generally arcuate transition groove extending therefrom and having a gradually smaller cross sectional area in a clockwise direction toward the adjacent inlet port 53. Preferably, the transition groove 79 would be formed only in the cover portion 13, but for obvious reasons would not be formed in the end plate 39. As is well known to those skilled in the art, the primary function of the transition groove 79 is to cause a transition from inlet pressure (low) to discharge pressure (high) in each slot 27 just after it ceases communication with an intake port 53. As is also well known to those skilled in the art, it is generally desirable to have the transition groove 79 extend circumferentially as shown in FIG. 4 such that it begins to communicate discharge pressure into the slot 27 at approximately the position where the slot passes out of communication with the intake port 53. It is also known that the transition groove 79 should be configured, in terms of cross sectional area, such that there is sufficient communication of fluid at discharge pressure into the slot 27, but at the same time, that the increase in pressure in the slot 27, from intake to discharge pressure, should not be too rapid. Because the importance of the transition groove 79 and its functional requirements are generally well known to those skilled in the art, there will be no further description herein of the particular transition groove geometry used in the present invention.

We claim:

1. In a balanced rotary pump of the type including housing means defining a pumping chamber, a pumping element rotatably disposed in the pumping chamber and defining a pair of expanding fluid chambers and a pair of contracting fluid chambers, the housing means defining a fluid inlet port in communication with the pair of expanding fluid chambers, and a fluid outlet port in communication with the pair of contracting fluid chambers, the pumping element including a rotor member mounted for rotation with an input shaft, the rotor member defining a plurality of slots, each of the slots receiving a radially displaceable roller vane member, the pumping chamber being defined by a continuous arcuate wall surface including a pair of inlet arc surfaces of progressively increasing radius in the direction of rotation of the rotor member, and a pair of discharge arc surfaces of progressively decreasing radius, each of said discharge arc surfaces comprising a high displacement cam surface; each of said slots including a driving surface disposed to engage and drive the adjacent one of said roller vane members when said pumping element is operating in a pumping mode, each of said slots also including an opposite surface; each of said driving surfaces including a substantial surface portion oriented at a negative angle relative to a radial line passing through the center of the adjacent roller vane member, the engagement of each of said roller vane members and its respective negative surface portion being effective to act to reduce the net radially outward force acting on said roller vane member, thereby reducing bouncing of said roller vane member as said roller vane member moves through said discharge arc surface. pg,13

2. In a balanced rotary pump of the type including housing means defining a pumping chamber, a pumping element rotatably disposed in the pumping chamber and defining a pair of expanding fluid chambers and a pair of contracting fluid chambers, the housing means defining a fluid inlet port in communication with the pair of expanding fluid chambers, and a fluid outlet port in communication with the pair of contracting fluid chambers, the pumping element including a rotor member mounted for rotation with an input shaft, the rotor member defining a plurality of slots, each of the slots receiving a radially displaceable roller vane member, the pumping chamber being defined by a continuous arcuate wall surface including a pair of inlet arc surfaces of progressively increasing radius in the direction of rotation of the rotor member, and a pair of discharge arc surfaces of progressively decreasing radius, each of said discharge arc surfaces comprising a high displacement cam surface; each of said slots including a driving surface disposed to engage and drive the adjacent one of said roller vane members when said pumping element is operating in a pumping mode, each of said slots also including an opposite surface; each of said driving surfaces including a substantial surface portion oriented at a negative angle relative to a radial line passing through the axis of rotation of said pumping element, and through the center of the adjacent roller vane member, each of said roller vane members, as it passes along said discharge arc surface, being engaged by its respective negative surface portion such that said negative surface portion exerts a radially inward force on said roller vane member, thereby reducing bouncing of said roller vane member.

* * * * *